US005548986A

United States Patent [19]

Matsuo et al.

[11] Patent Number: 5,548,986

[45] Date of Patent: Aug. 27, 1996

[54] METHOD AND APPARATUS FOR SIMULTANEOUSLY FORMING AT LEAST FOUR METAL ROUNDS

[75] Inventors: Giichi Matsuo; Akira Sakai, both of Tokyo, Japan; Jeral Rains, Seguin; Dayton Elley, McQueeney, both of Tex.

[73] Assignees: Structural Metals, Inc., Seguin, Tex.; NKK Corporation, Tokyo, Japan

[21] Appl. No.: 273,597

[22] Filed: Jul. 11, 1994

Related U.S. Application Data

[63] Continuation-in-part of Ser. No. 215,388, Mar. 21, 1994, abandoned, and a continuation-in-part of Ser. No. 855,010, Apr. 22, 1992, abandoned.

[51] Int. Cl.[6] ..... B21B 1/18; B21B 27/02

[52] U.S. Cl. ..... 72/204; 72/252.5; 72/366.2; 83/407

[58] Field of Search ..... 72/203, 204, 234, 72/235, 252.5, 365.2, 366.2; 83/407, 425

[56] References Cited

U.S. PATENT DOCUMENTS

| | | | |
|---|---|---|---|
| 1,977,285 | 10/1934 | McLeery | 72/204 |
| 2,335,334 | 11/1943 | Yoder | 72/204 |
| 4,193,283 | 3/1980 | Bowman et al. | 72/204 |
| 4,204,416 | 5/1980 | Chumanov et al. | 72/204 |
| 4,275,491 | 6/1981 | Marinucci | 72/204 |
| 4,357,819 | 11/1982 | Elley | 72/204 |
| 4,370,910 | 2/1983 | Suzuki et al. | 72/203 |

FOREIGN PATENT DOCUMENTS

| | | |
|---|---|---|
| 54-33252 | 3/1979 | Japan . |
| 57-112902 | 7/1982 | Japan . |
| 59-24503 | 2/1984 | Japan . |
| 60-18241 | 5/1985 | Japan . |
| 60-92001 | 5/1985 | Japan . |
| 60-130404 | 7/1985 | Japan . |
| 61-229402 | 10/1986 | Japan . |
| 62-2882 | 1/1987 | Japan . |
| 1-53121 | 11/1989 | Japan . |
| 2-21882 | 5/1990 | Japan . |

*Primary Examiner*—Lowell A. Larson
*Assistant Examiner*—Thomas C. Schoeffler
*Attorney, Agent, or Firm*—Akin, Gump, Strauss, Hauer & Feld, L.L.P.

[57] ABSTRACT

This invention relates to a method and apparatus for simultaneously forming four metal rounds and includes disclosure of two pair of forming rollers, a preslitter roller pair and two pair of slitting rollers, the dimensioning of the ridges and grooves of which, in combination, serve to separate an entering bar into four strands of substantially equal area for simultaneous forming into metal rounds.

24 Claims, 15 Drawing Sheets

METHOD AND APPARATUS FOR SIMULTANEOUSLY FORMING AT LEAST FOUR METAL ROUNDS

This application is a continuation-in-part of U.S. application Ser. No. 08/215,388 filed Mar. 21, 1994, now abandoned, and also of U.S. application Ser. No. 07/855,010 filed on Apr. 22, 1992, now abandoned, based on Ser. No. PCT/JP91/01263 dated Sep. 21, 1991.

FIELD OF THE INVENTION

This invention relates to the forming of small diameter metal rounds, such as reinforcing bar rounds. More specifically, this invention relates to methods and apparatus for simultaneously forming by rolling at least four rounds of uniform size from a single billet.

BACKGROUND OF THE INVENTION

The forming of small diameter rounds from larger bars is known in the milling art. Generally, a large bar is successively passed through a series of rollers that reduce the cross sectional area of the bar and, through a number of intermediate steps, eventually forms the desired shape. In this context, the bar includes not only a bar whose cross section is substantially round, but also a bar whose cross section is slightly oval or square-shaped and a ribbed bar which is the above-mentioned bar, on which ribs are formed. Because the amount of the reduction of the cross sectional area on each pass through the rollers is limited, the smaller the cross sectional area of final product, the larger the number of roller passes, machinery and production floor space required.

The simultaneous forming of multiple rounds significantly reduces the above-stated problems because the reduction in total cross sectional area is considerably less, therefore, fewer intermediate steps are required and the speed and length of the end product is reduced.

It is known in the art to simultaneously produce two uniform metal rounds and three uniform metal rounds. The simultaneous production of three rounds is described in U.S. Pat. No. 4,357,819.

In addition, the following methods for producing a plurality of bars from a single preformed billet in a finishing rolling train have also been proposed:

(1) A method for simultaneously producing three strands of bars from a single preformed billet in a finishing rolling train, is disclosed in Japanese Patent Application Laid Open No. 24,503/84 of Feb. 8, 1984 (hereinafter referred to as the "Prior Art 1).

In this method, a finishing rolling train is composed of 4 stands $K_4$, $K_3$, $K_2$, and $K_1$ (not shown) arranged in series in the rolling direction. The $K_4$ and $K_3$ stands roll a preformed billet to produce three strands of bars 2*a*, 2*b* and 2*c* connected to each other by means of thin connecting portions 2*d* and 2*e* as shown in FIG. 9(A). A pair of slit rolls (not shown) cut the three strands of bars 2*a*, 2*b* and 2*c* along the connecting portions, and then stand $K_2$, composed of a pair of calibered rolls, rolls the three cut strands of bars 2*a*, 2*b* and 2*c* to produce bars of oval cross section as shown in FIG. 9(B). Then stand $K_1$ composed of a pair of rolls with a finishing caliber (a bore type), rolls the three strands to produce final product bars 3*a*, 3*b*, and 3*c* as shown in FIG. 9(C). FIG. 9(A) shows a state of rolling a billet at the stand $K_3$. FIG. 9(B) shows a state of strands having been cut off by means of a pair of slit rolls, following the $K_2$ stand. FIG. 9(C) shows the shapes of bars 3*a*, 3*b* and 3*c* after the bars have been rolled at the stand $K_1$.

(2) A method for simultaneously producing four strands of bars from a single preformed billet is disclosed in Japanese Patent Application No. 92,001/85 of May 23, 1985 (hereinafter referred to as the "Prior Art 2").

The "Prior Art 2" was developed to enhance the productivity of the method of the "Prior Art 1." According to the method of the "Prior Art 2,"bars are produced as follows:

Four strands 4*a*, 4*b*, 4*c* and 4*d* connected to each other by thin connecting portions 4*e*, 4*f* and 4*g* are formed as shown in FIG. 10(A) by means of stands $K_4$ arid $K_3$ (not shown). The four strands 4*a*, 4*b*, 4*c* and 4*d* as shown in FIG. 10(B) are cut off along the central connection portion 4*f* by means of a first pair of slit rolls (6) between stands $K_3$ and $K_2$ (not shown) as shown in FIG. 11. Then, four bars 4*a*, 4*b*, 4*c* and 4*d* as shown in FIG. 10(C) are obtained by cutting off along the connecting portions (4*e*, 4*g*) by means of two pairs of second slit rolls (7, 8). Subsequently, bars 5*a*, 5*b*, 5*c* and 5*d* as final products, as shown in FIG. 10(D), are produced by simultaneously rolling the four bars 4*a*, 4*b*, 4*c* and 4*d*. Processes of rolling and cutting the strands are shown in FIGS. 10(A) to 10(D) and the positions of the slit rolls on the plane are shown in FIG. 11.

As compared with the simultaneous production of three rounds, the additional problems involved in producing four rounds simultaneously from one bar are significant. The problems include maintaining the uniformity of the cross sectional areas of the strands as well as avoiding the cobbling of the strands during the slitting process. Other considerations include the resistance produced when separating the strands, which resistance can result in excessive heat, lower separating speeds and lower efficiency.

The preferred embodiment of the method and apparatus of the present invention includes simultaneously slitting a billet into more than four strands or rounds by forming the billet into the desired number of shapes for rounds and separating the outer most strands from the remaining billet before separating the next outer most set of strands from the billet until the billet has been divided into a desired number of strands. Where there is an odd number of strands to be separated, of course, when the last pair of outer strands is separated only the inner most or center strand will remain.

SUMMARY OF THE INVENTION

The invention includes a method and apparatus for simultaneously forming at least four metal rounds of approximately equal cross sectional area from a single bar that has been formed into four strands of substantially equal cross sectional area which are separated by thin connecting portions. The apparatus includes a first pair of slitter rollers having ridges for interfering with the outside strands to separate the two outside strands from the two inside strands and a second slitter roller for separating the two inside strands from each other after the outer strands have been removed from the billet.

The invention also includes a method and apparatus for producing four or more strands by simultaneously finishing a single billet by rolling it to form a number of strands connected to each other by thin connecting portions and then cutting of the two outside strands by cutting along the thin connecting portions connecting them to the remainder of the billet and then successively cutting off the two remaining outer strands from the remainder of the billet until all strands have been removed.

The invention includes apparatus for simultaneously forming at least four metal rounds from a single billet that has been formed into four connected strands of substantially equal cross sectional area with a pair of pre-slitter rollers having forming surfaces defining two central grooves and two outside grooves, the four grooves being separated by three serial ridges with each central groove defining a groove cross sectional area, the groove cross sectional area comprising a strand cross sectional area plus a free space, the free space being sufficient to accommodate a variance in strand cross sectional area without requiring redistribution of metal from strands within the central grooves to strands outside the central grooves.

In the preferred embodiment, the outside slope angles of the ridges of the first slitter rollers exceed the inside slope angles of the corresponding portions of the outside strands by approximately 22°. Further, it has been found effective if the outside slope angle of the ridges of the first slitter rollers are approximately 52°.

The apparatus may further include inside slope angles for each ridge of the first slitter rollers that are less than the outside slope angle of the corresponding middle strand. It has been found effective if the inside slope angles of the first slitter rollers are approximately 25°.

In the preferred embodiment, the means for separating the two middle strands is comprised of a slitter roller pair wherein at least one roller has a ridge located to correspond to the thin connecting portion between the two metal strands. The slope angles of the slitter roller ridge are greater than the corresponding inside slope angles of the middle strands. It has been found effective if the inside slope angles of the ridge exceed the corresponding inside slope angles of the middle strands by approximately 5°. Thirty-five degrees (35°) has been found to be an effective slope angle for the ridge of the second slitter roller.

The invention includes a method for forming a bar to be slit and simultaneously formed into four metal rounds that comprises adjusting the separation distance between each roller in a first pair of forming rollers and between the rollers in a second pair of forming rollers. The method includes passing a bar by the first of rollers to form a bar of fixed cross-sectional width and fixed cross-sectional height over end portions of the bar, and passing the bar by the second pair of rollers to form a bar of fixed cross-sectional height over central portions of the bar. The method includes, subsequent to the above steps, passing the bar by a pair of pre-slitter rollers. The pre-slitter rollers have three ridges for forming four serial strands of approximately equal cross-sectional area separated by thin connected portions.

The invention also includes a method of slitting a bar comprised of four serial strands, two outside and two middle, of approximately equal cross-sectional area separated by thin connecting portions. The method comprises passing the bar by a first pair of slitter rollers, each having two ridges with interfering outside slope angles and noninterfering inside slope angles. Such passing of the bar serves to separate each outside strand from the two middle strands by applying a lateral force with portions of the outside of the ridge to portions of the inside surface of an outside strand. At the same time, significant lateral force is not applied with the inside surface of a ridge to the outside surface of a middle strand. The method includes subsequently separating the two metal strands.

DESCRIPTION OF THE PREFERRED EMBODIMENT

Figure 1:
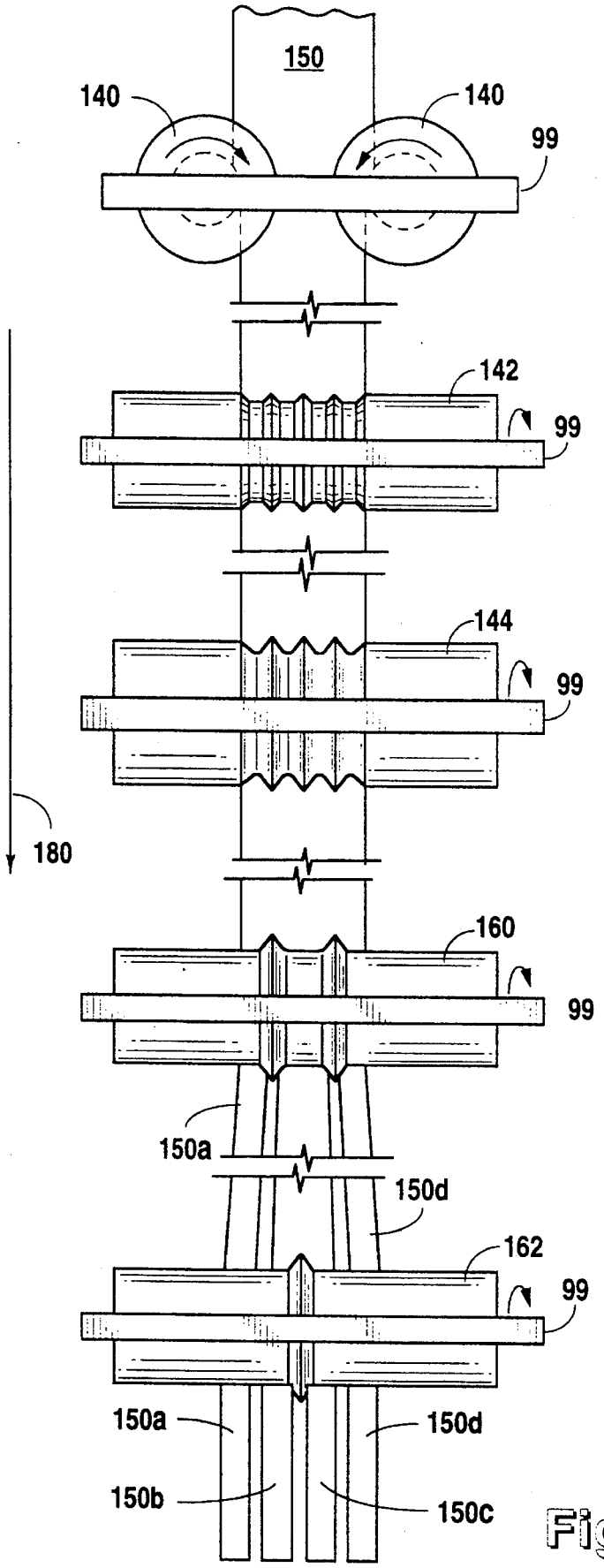
FIG. 1 comprises a schematic plan view of a series of connected forming and slitting rollers of the preferred embodiment.
Figure 3A:
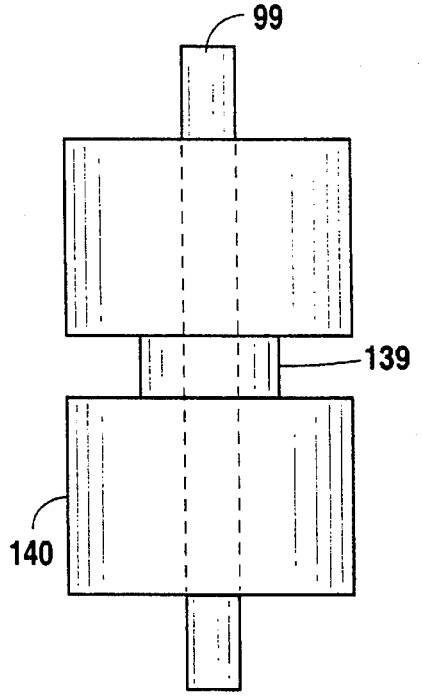
FIG. 3A is an elevational view of one of a pair of forming rollers.

As schematically shown in FIG. 1, a metal bar 150 moves in the direction of arrow 180 past five roller stands. First rollers 140 are shown installed with their axis of rotation in the vertical direction. Since the schematic view is presented as from above and the following four roller pairs are illustrated as installed vertically, one above the other, only one roller of the subsequent four pairs, roller 142, roller 144, roller 160 and roller 162, is shown. For the same reason, rollers 140 have a central groove 139 that is not shown in FIG. 1 but is shown in FIG. 3A.

As bar 150 proceeds through the series of roller stands in the direction of arrow 180, it takes on new cross sectional shapes as a function of the shape of the grooves and the ridges found in the surface of the rollers and, to some extent, of the separation distance between the rollers in a pair.

Rollers 160 and 162 are slitter rollers. As illustrated in FIG. 1, roller 160 slits bar 150 into a central portion and two outside strands, 150*a* and 150*d*. Slitter roller 162 slits the central portion of bar 150 into strands 150*b* and 150*c*. That is to say the present invention is characterized in that the thin connecting portions between the two outer strands 150*a* and 150*d* and the adjacent inner strands 150*b* and 150*c* respectively are cut off by means of the first pair of slitter rollers 160.

Figure 2A:
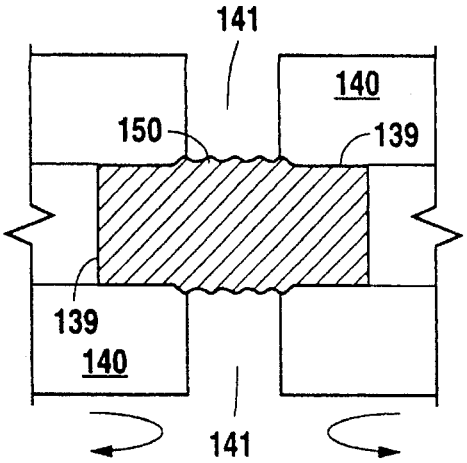
FIGS. 2A through 2G illustrate the bar subsequent to the forming passes, the slitting passes and further forming passes.
Figure 2B:
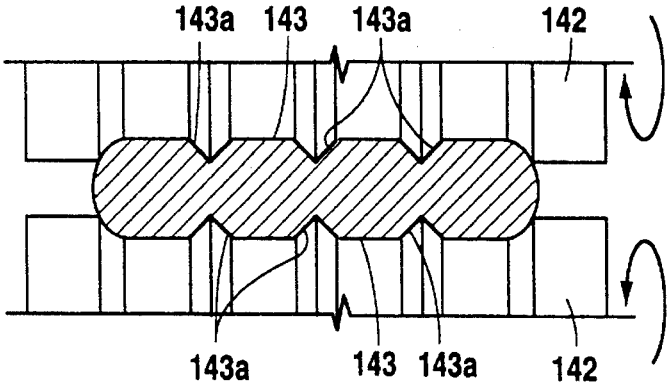
Figure 2C:
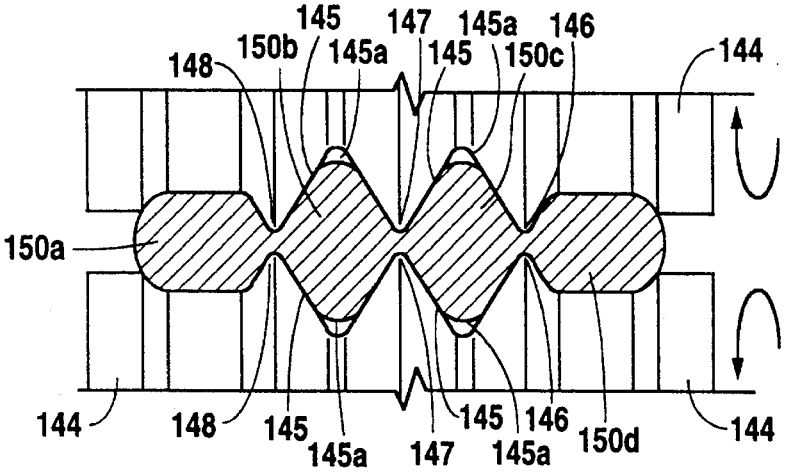
Figure 2D:
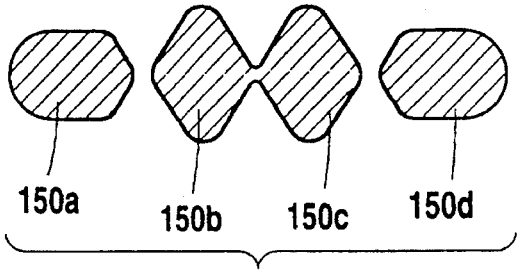
Figure 5:
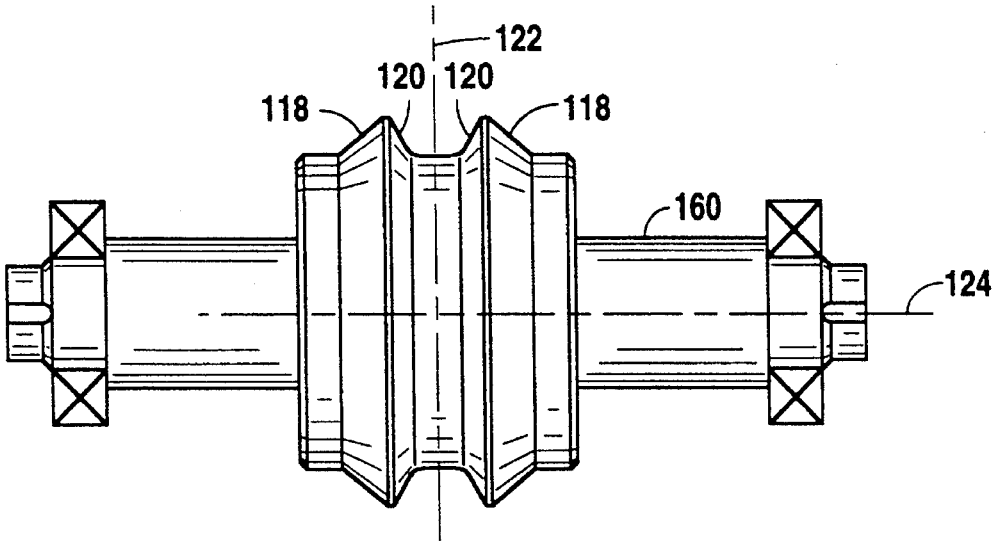
FIG. 5 is an elevational view of a slitter roller.

More particularly, slitter rollers 160, one of which is illustrated in more detail FIG. 5, will slit the bar 150 comprised of four serial strands 150*a*, 150*b*, 150*c* and 150*d* connected by thin connecting portions, as illustrated in FIG. 2C, into a middle portion comprised of strands 150*b* and 150*c* still connected by a thin connecting portion and separate outside strands 150*a* and 150*d*, as illustrated in FIG. 2D.

An important aspect of the present invention is that initially both of the outer strands are cut off, and then the two inside strands are separated from each other, which is in sharp contrast to Prior Art 2. Also important is that the slitter rollers 160 have ridges formed so that the separated outside strands 150*a* and 150*d* are directed outwardly, or laterally, away from the portion in which the inside strands are still connected to each other. Likewise, slitter rollers 162 have their ridges arranged to direct strands 150*b* and 150*c* away from each other.

Figure 2E:
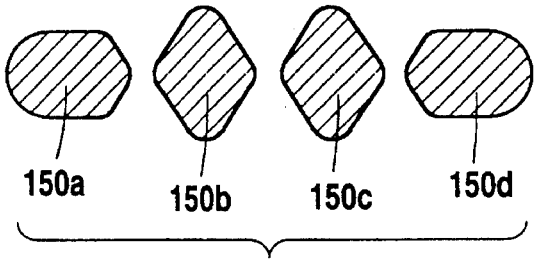
Figure 2F:
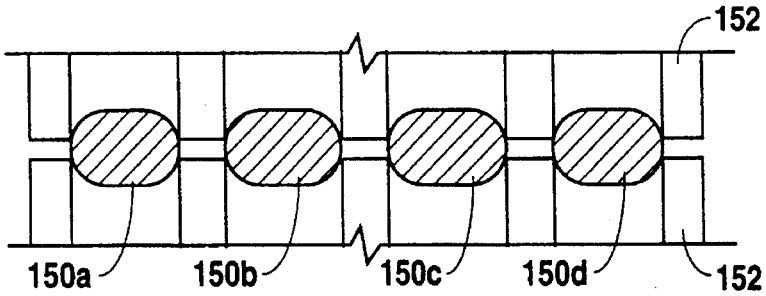
Figure 2G:
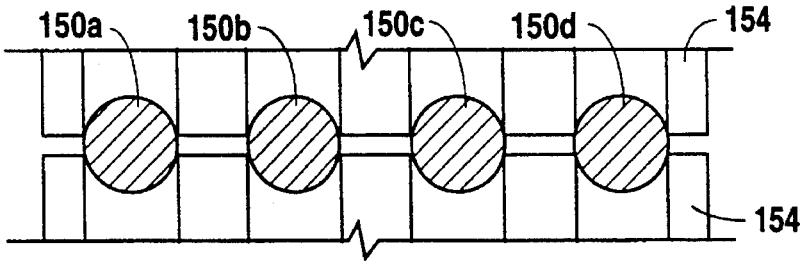
Figure 6:
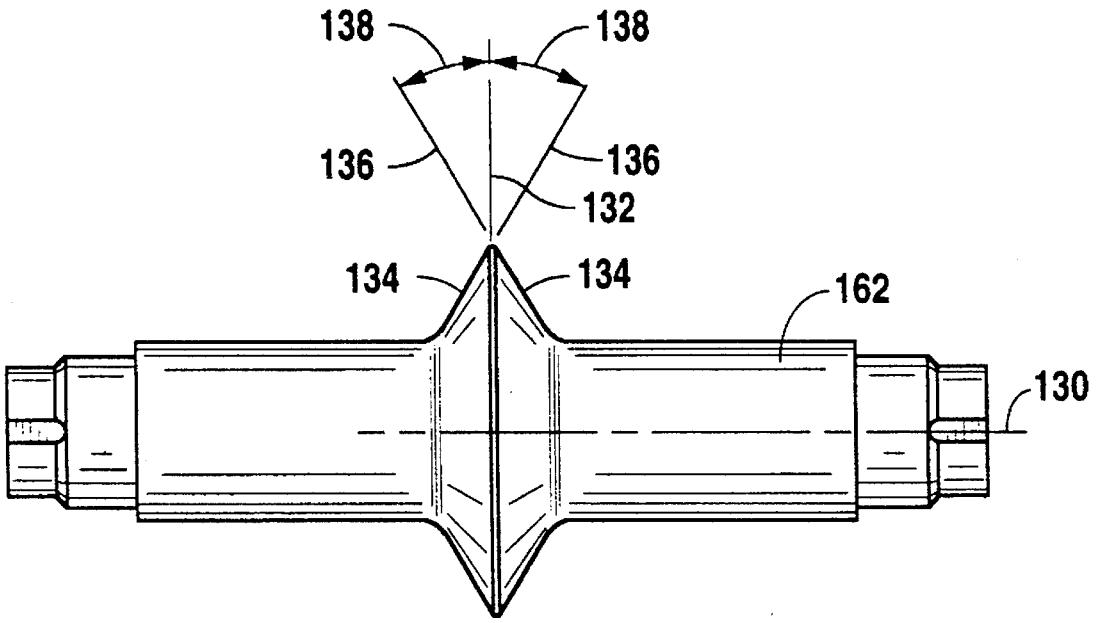
FIG. 6 is a view of a single ridge slitter roller.

Slitter rollers 162, one of which is illustrated in FIG. 6, separates middle section 150*b* and 150*c* connected by thin connecting portions, as illustrated in FIG. 2D, into two separate strands 150*b* and 150*c* as illustrated in FIG. 2E. FIGS. 2F and 2G illustrate a subsequent working of the four separated strands 150*a*, 150*b*, 150*c* and 150*d* by rollers 152 and rollers 154 into four uniform rounds. This subsequent simultaneous working, illustrated in FIGS. 2F and 2G, is understood by those skilled in the art. Hence, the details of such working will not be further discussed.

In a review of FIGS. 2A and 2B, it can be seen that bar 150 as it emerges from rollers 140 has a predetermined width and the height of its end portion is determined. Bar 150 as it emerges from rollers 142 of FIG. 2B has the height of its central portion determined. In the preferred embodiment, bar 150 as it emerges from rollers 142 contains in fact four portions separated by thick connecting portions, the thick connecting portions being formed by ridges 143*a*. Bar 150, after completing the pass of rollers 140 and 142, is known to be divided, by one who is informed of the dimensions of rollers 140 and 142, into four portions of substantially equal area.

Figure 1A:
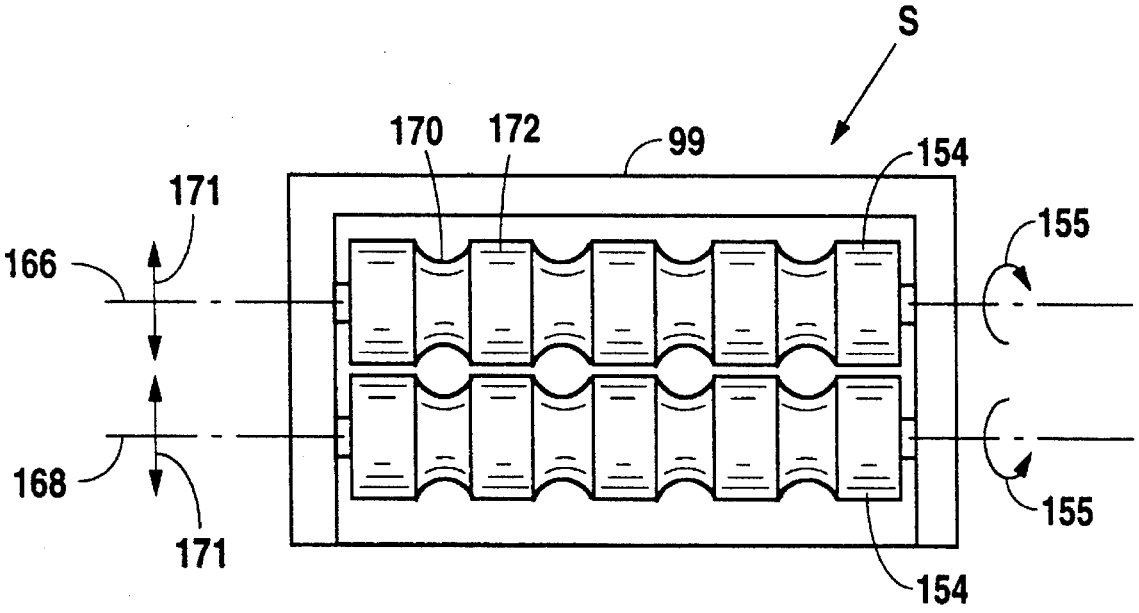
FIG. 1A comprises a schematic elevational view of a prior art roller stand.

When rollers 154 of FIG. 1A are rotated in the direction indicated by the arrows 155, the bar of metal, now separated into four strands, will be drawn through the rollers and would move in a direction out of, and perpendicular to, the surface of the paper. The bar, or strands, may be regarded as having a length, a width and a height. The width and the height are cross sectional dimensions. Rollers 154 form the cross sectional dimensions of the bar or strands.

In roller stand S, the axes of the rollers, indicated by dashed lines 166 and 168, are usually adjustable with respect to each other. This permits adjustment of the separation distance between the surfaces of the rollers. The adjustability of the axes is indicated by the arrows 171 associated with axes 166 and 168. The separation distance between the rollers affects the form of the bar and the cross sectional area of the strands created. The ability to vertically adjust also permits compensation for wear of the roller surfaces.

The cylindrical surfaces of the rollers are conventionally sculpted, or dimensioned, to contain circumferential grooves 170 and ridges 172. A ridge, as the word is used herein, may present a flat top surface, as illustrated in FIG. 1A, or may rise to a nearly pointed or a pointed surface, as in roller 144 of FIG. 1. The grooves and ridges serve to form the bar in a pass. The cross sectional area of the bar will exhibit a configuration conforming or semi-conforming to the cross sectional area between the rollers. The degree of confirmation depends upon the design of the rollers and the extent to which they contain free space in or around the grooves.

The grooves are designed with respect to the anticipated cross sectional area of the incoming bar. The separation distance of the rollers may be adjusted such that the metal of the bar is forced to flow into, conform to, and fill all of the space of the groove. Excess metal, in such case, may move during the pass toward the free space at the side of the rollers. The grooves may also be designed, in conjunction with the separation distance, to a depth that defines a free space therein. The free space serves to substantially eliminate the flow of metal from a groove during a pass.

The preferred embodiment illustrated herein assumes that the grooves and ridges of a roller pair are sculpted identically onto the face of each roller to form a matched pair. However, it will be appreciated by those skilled in the art that the invention may function if the rollers of a roller pair are designed with non-matching grooves and/or ridges.

The term "slope angle" as used herein indicates the angle between the "vertical" and a tangent drawn to a point on a ridge or a strand. A "vertical" in regard to a ridge is perpendicular to the axis of a horizontal roller. A "vertical" in regard to a strand is perpendicular to the axis of the rollers of the immediately previous roller pair that passed and formed the strand. Reference is made to "inside" and "outside" "slope angles" of ridges and strands. "Inside" refers to a side facing toward the inside of the rollers or the inside of the strand. "Outside" refers to a side facing toward the outside of the rollers or the outside of the strand. When this reference is used, it is to be understood that, with respect to a strand, only the slope angles of "central portions" of sides of a strand are indicated. When the "slope angle" of a ridge of the roller is referred to, it is to be understood that only the slope angles of portions of the ridge that "correspond to" central portions of a corresponding side of a strand are indicated.

Figure 4:
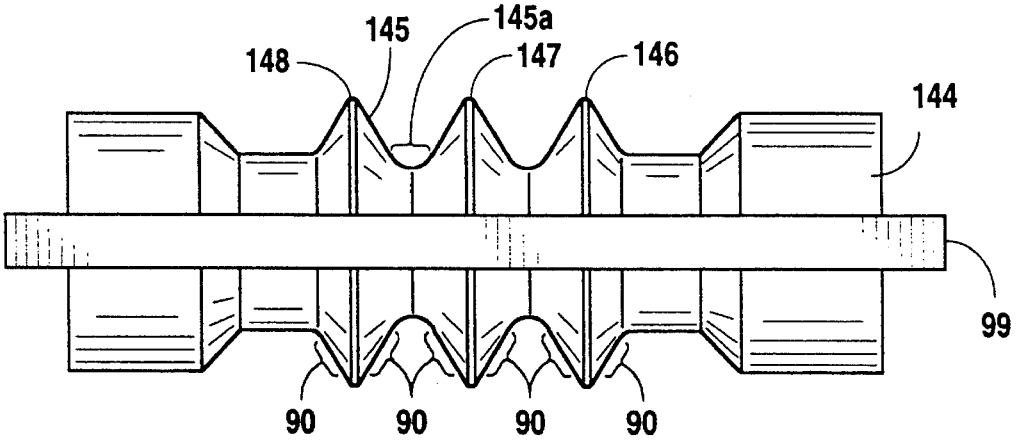
FIG. 4 is an elevational view of one of a pair of pre-slitter rollers.

For instance, in FIG. 4 the area designated 90 illustrates the portions of ridges 146, 147 and 148 that correspond to the slope angles of central portions of the strands formed by the ridges. In FIG. 5B, the areas designated 165 and 166 comprise illustrative central portions of sides of a strand.

The slope angle of the strands in their "central portions" is referred to because it is against these side walls of the strands that the slitter rollers, to be discussed below, either do or do not "interfere," or do or do not exert a lateral force. As discussed below, a lateral force can be exerted by a ridge of a slitter roller. When this ridge exerts the lateral force, it is said that the ridge has a slope angle, at least in portions corresponding to central portions of the strand, that would "interfere" with the slope angle of the strand.

The actual slope angle in "non-central" portions where, for instance, strand 150*c* or strand 150*d*, as illustrated in FIG. 5B, intersect the thin connecting portion (not numbered) separating the two strands, is not so significant. It is the slope angle along the "central portions" of the side slope of the strand that is important. These central portions either will receive a lateral force from the interference of the slitter roller slope angle or there will be no interference. For instance, as illustrated in FIG. 5B, which is included for illustrative purposes, not as part of the preferred embodiment, one ridge of slitter roller 160 is shown inserted within or between the side walls of strands 150*c* and 150*d* to the point where it touches or virtually touches the thin connecting portion. It may be that where the peak of the ridge on slitter roller 160 meets or almost meets the thin connecting portion, the slope angle of the ridge is in fact less than the slope angles of strands 150*c* and 150*d*.

As illustrated in FIG. 5B, the slope of the inside central portion of the wall of strand 150*d* is defined by the angle between tangent 115 drawn to that inside strand wall and vertical 122. This angle is illustrated as angle 106 in FIG. 5B. The slope of the corresponding central portion of the ridge of the slitter 160 is illustrated by angle 104 drawn between vertical 122 and tangent 119 drawn at a "central portion" 165 of the outside of the ridge of slitter roller 160.

Similarly, when measuring the relative slope angles of the inside surface of the slitter ridge vis-a-vis the outside surface of strand 150*c*, the relevant central portion of strand 150*c* is denominated by numeral 166 in FIG. 5B. Tangent 117 drawn to a point on a central portion of a strand 150*c* makes angle 100 with vertical 122. Tangent 121 drawn to a corresponding central portion of the ridge of slitter roller 160 makes angle 102 with vertical 122. The relative sizing between angles 104 and 106 and between angles 100 and 102 determine whether the ridge of the slitter roller interferes, or does not interfere, with the side wall of the strand.

After the four separated strands emerge from slitter roller 162, they will be formed into metal rounds by a further series of forming rollers, as is known in the art. As mentioned above, the dimensioning of the grooves and ridges on the roller surfaces, as well as the adjustment of the separation distance between the rollers of a pair, determines the effect of the grooves and ridges upon the metal bar passing the stand. Such effect is illustrated for the preferred embodiment in FIGS. 2A through 2G.

FIG. 2A illustrates rollers 140 installed with their axes of rotation in the vertical direction. FIG. 1B illustrates one forming roller 140 in greater detail. The separation distance between the surfaces of rollers 140 is established such that one central groove 139 in each roller conforms each end portion of bar 150 to the dimensions of the groove. The adjustment of the separation distance between rollers 140 determines the width of the bar. The height of groove 139 determines the height of each end portion of bar 150 as it passes rollers 140. Free space 141 (see FIG. 2A) between the rollers accommodates the flow of any excess metal from the ends of the bar into the central portion of the bar.

Figure 3B:
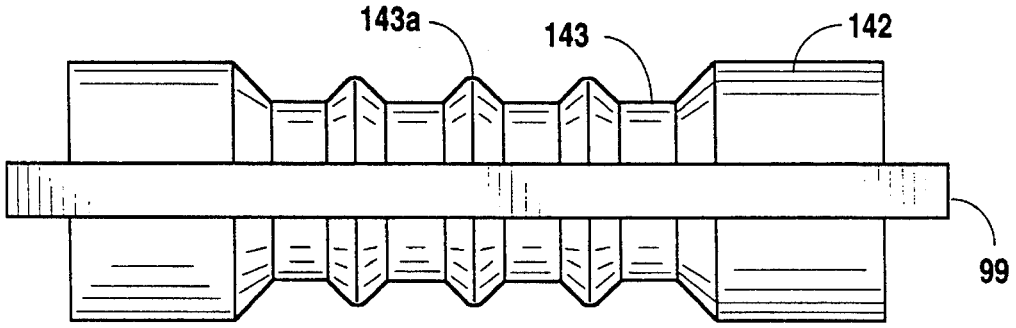
FIG. 3B is an elevational view of one of a pair of forming rollers.

Rollers 142 of FIG. 2B are illustrated installed with their axes of rotation in the horizontal direction, as are all succeeding roller pairs. FIG. 3B illustrates one roller 142 in greater detail. Rollers 142 have sculpted in their surface a series of flat grooves 143 and ridges 143*a*. The separation distance between rollers 142 is adjusted such that the metal of the bar fills the space in the central portion of the rollers between the roller surfaces. Thus, the height and shape of at least the central portion of the bar is formed by rollers 142. Excess metal is accommodated by being permitted to flow to the outside space between the two rollers.

Those skilled in the art will appreciate that bar 150 is guided between roller pairs 140, 142, 144 and the slitter rollers. Thus, the grooves and ridges of one roller pair can be aligned in combination with the grooves and ridges of a prior roller pair. They can be dimensioned in combination to create an effect in sequence.

Both rollers 144 in the preferred embodiment contain three ridges 146, 147 and 148. Although, it is preferred that both rollers contain the ridges, one roller with the ridges could suffice. FIG. 4 illustrates one roller 144 in greater detail. Ridges 146, 147 and 148 are dimensioned to establish four strands in bar 150, namely 150*a*, 150*b*, 150*c* and 150*d* (see FIG. 2C). The four strands are connected by thin connecting portions. Strands 150*a* and 150*d* are outside strands. Strands 150*b* and 150*c* are inside strands. Ridges 146, 147 and 148 not only establish thin connecting portions between four serial strands but also establish certain slope angles that the strands assume.

Roller pair 144 also contains two grooves 145 that provide for free space 145*a* above middle strands 150*b* and 150*c* formed in grooves 145. The free space permits the forming of the thin connecting portions by the rollers of pair 144 without redistributing metal from the middle strands to the outside strands. The free space accommodates a certain variance in cross sectional area of middle strands 150*b* and 150*c*.

One problem to be solved in the simultaneous forming of four metal rounds is maintaining the uniformity of the cross sectional area of the four metal rounds. That is, the diameter of the rounds should conform to specifications within a certain tolerance. The words "substantially equal area" are used herein to indicate that the cross sectional area of the four portions would, if formed into rounds, have diameters that conformed to the specifications within the given tolerance.

As discussed above, the first two passes by the forming rollers form entering bar 150 to four portions of substantially equal cross sectional areas. Pre-slitter rollers 144 separate the bar into four strands separated by thin connecting portions. The substantially equal cross sectional area is maintained. Pre-slitter rollers 144 also establish slope angles of the strand.

In the preferred embodiment, the two outside strands are first slit from the two middle strands by slitter rollers 160. Subsequently, the two middle strands are slit by slitter rollers 162. This is illustrated in FIG. 1 and FIGS. 2*d* and 2*e*. The slitting is performed by applying a lateral horizontal force to the walls of the strands, effecting a tearing along the thin connecting portions. The lateral force is delivered by the interference of the slope angle of a side of a ridge of the slitter roller with the slope angle of a corresponding side of a strand. The slitter rollers 160 are designed such that the surface 118 formed on the outside of the slitter roller ridge (see FIGS. 5 and 5A) has a slope angle 104 greater than the inside slope angle 106 formed on the strands 150*a* and 150*d*. In the preferred embodiment, the difference in the slope angles 104 and 106 is approximately 22°. The slope angle 104 is preferably approximately 52° while the slope angle 106 is approximately 30°.

In the preferred embodiment, the inside slope angle 102 of the ridges of slitter roller 160, that is, the angle formed by side 120, is less than the outside slope angle 100 of strands 150*b* and 150*c*. The difference is approximately 5°. In the preferred embodiment, the outside slope angle 100 of strands 150*b* and 150*c* is approximately 25°. In such a fashion, lateral separating forces are applied to strands 150*a* and 150*d* without applying a friction force to the two captive inside strands 150*b* and 150*c*.

Figure 5A:
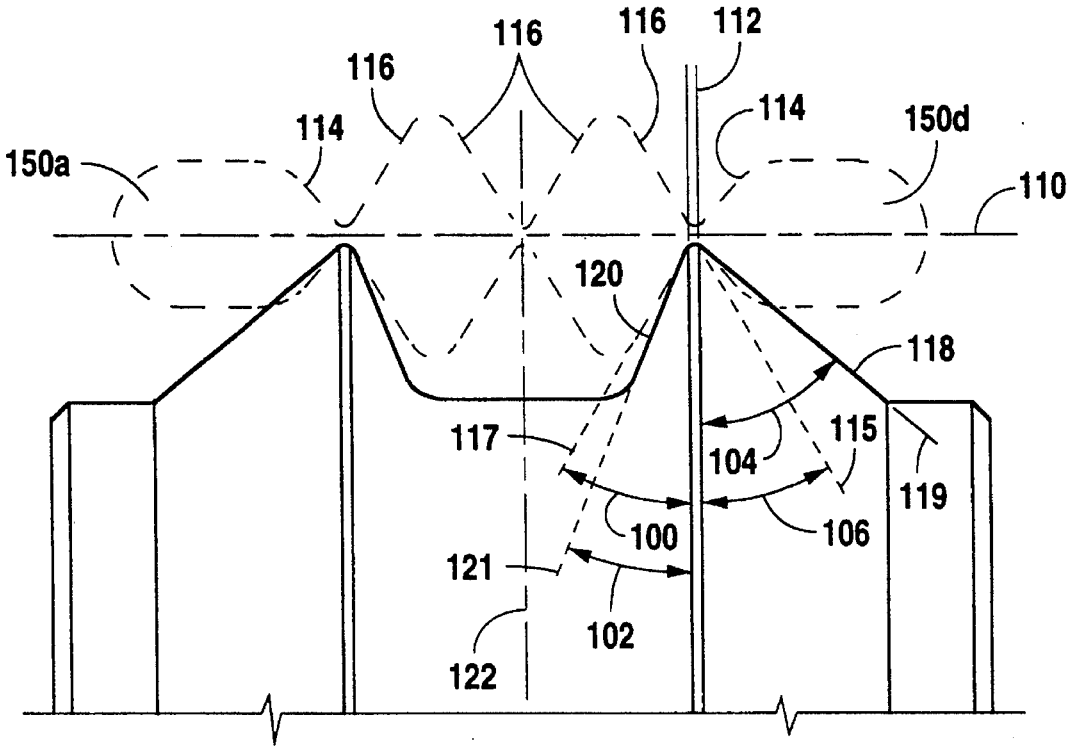
FIG. 5A is an illustrative view of the interaction of a bar formed into strands with a slitter roller.
Figure 5B:
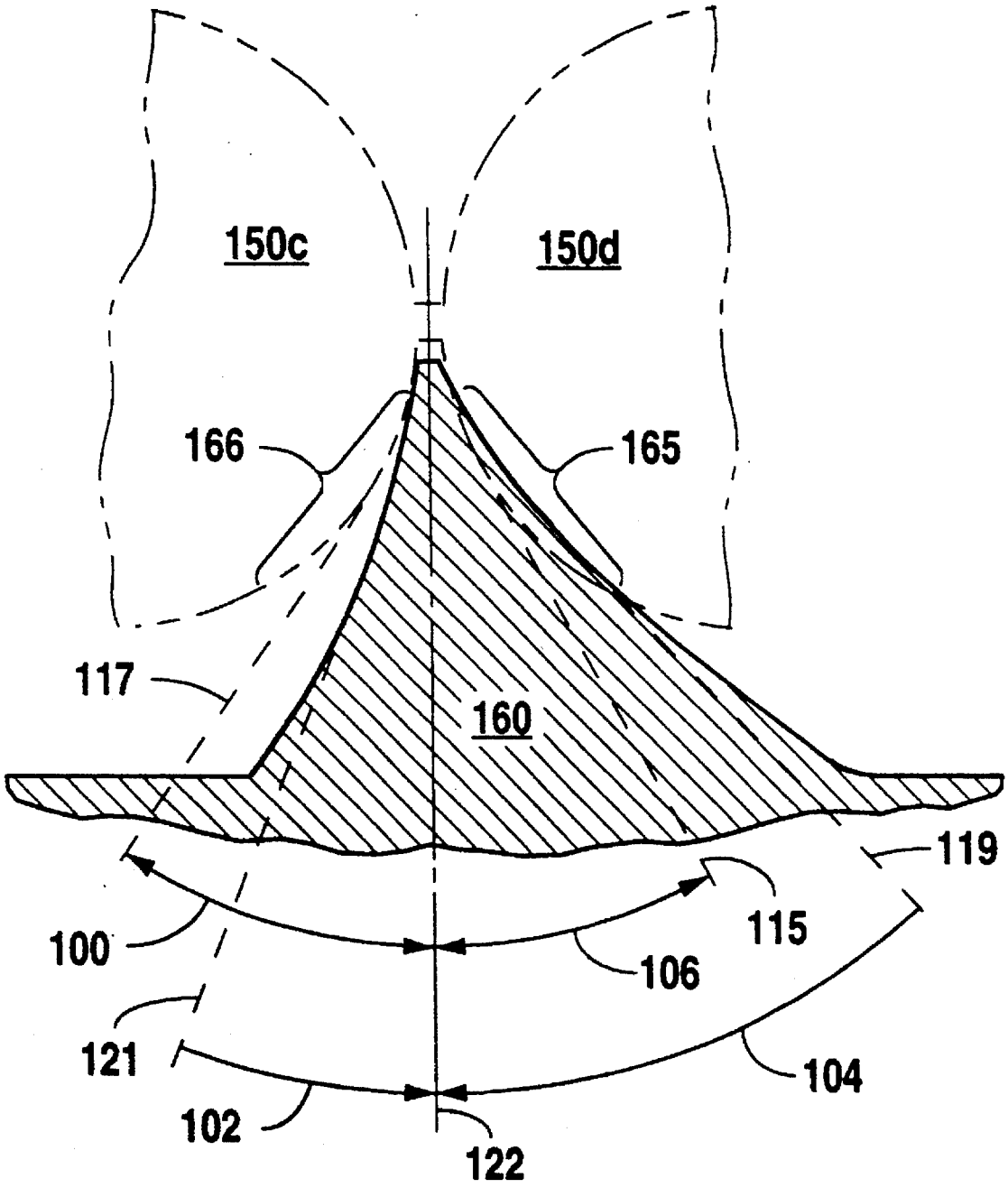
FIG. 5B is an illustrative closeup of a detail of the interaction of the ridge of a slitter roller with the sides of the strands of a bar.

Although the side walls of the ridges of slitter roller 160, as illustrated in FIGS. 5 and 5A, are shown approximately straight, i.e. side walls 118 and 120, it should be understood that the side walls of the ridge of slitter roller 160 could assume a continuously curved configuration. They should be designed with curved configuration similar to that given to strands 150*a*, 150*b*, 150*c* and 150*d*, at least in their central portions, by the ridges 146, 147 and 148 of pre-slitter rollers 144.

Figure 6A:
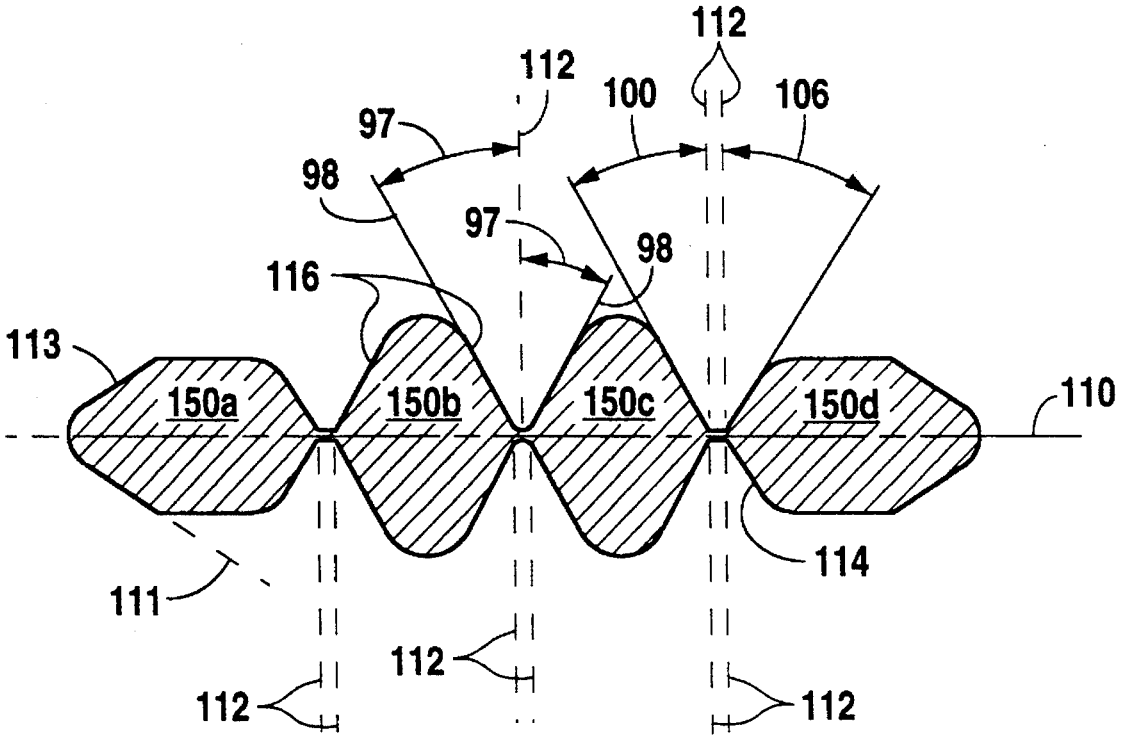
FIG. 6A is a view of a bar separated into four strands connected by thin connecting portions.

As illustrated in FIGS. 6 and 6A, inside edge 134 of the ridge of second slitter roller 162 forms angle 138 with vertical 132. The inside slope angles of strands 150*b* and 150*c* make angle 97 between tangents 98 and vertical 112. In the preferred embodiment, angles 138 are greater than angles 97. In fact, angles 138 exceed angles 97 by 5°. In the preferred embodiment, the inside slope angle 97 is essentially 35°. With such arrangement, second slitter roller 162 applies a lateral force and separates by tearing strand 150*b* from strand 150*c*.

Figure 7A:
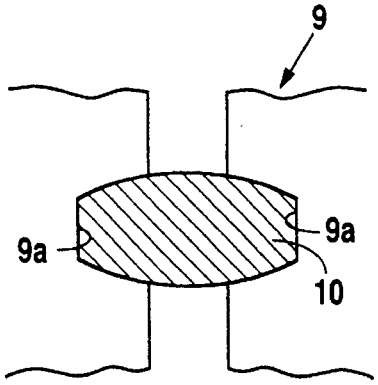
FIGS. 7(A) to 7(H) are explanatory views showing the processes of deformation of the strands by roll calibers from the roll strands $K_5$ to $K_1$ in the case of simultaneously rolling five strands of bars.

FIGS. 7(A) to 7(H) show an embodiment wherein five bars are simultaneously produced. FIGS. 8(A) to 8(I) show an embodiment wherein six bars are simultaneously produced. The method for simultaneously producing five bars or six bars is quite the same as the method for simultaneously producing four bars. However, additional explanation is given below as follows:

FIG. 7(A) shows a roll caliber 9*a* in a pair of rolls 9 and a preformed billet 10.

Figure 7B:
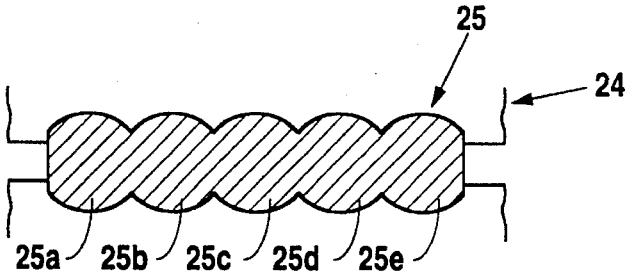

FIG. 7(B) shows a process in which five strands 25*a* through 25*e*, each having equal cross section area, are rolled by means of a pair of rolls 24.

Figure 7C:
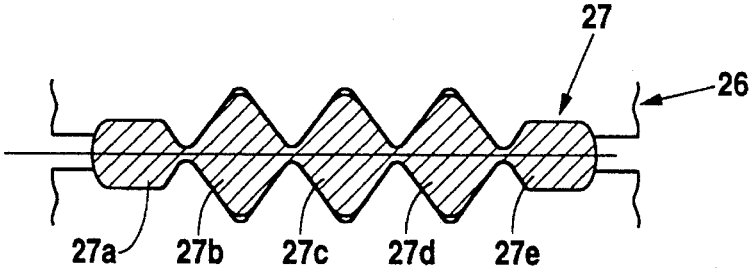

FIG. 7(C) shows a process in which both the outer strands 27*a* and 27*e* are rolled to form strands of oval shape or of a box-shape, and intermediate three strands 27*b* through 27*d* are rolled to form strands of a diamond shape or oval shape which is longer in vertical directions, by means of a pair of rolls 26.

Figure 7D:
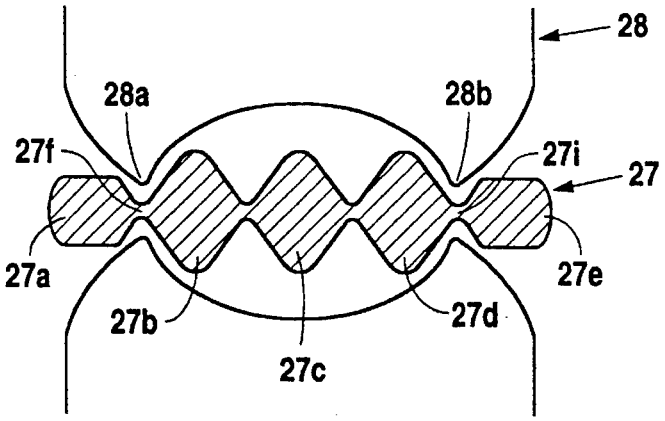

FIG. 7(D) shows a process in which both the outer two strands 27*a* and 27*e* are cut off by means of two edges 28*a* and 28*b* of the first pair of slitter rollers 28.

Figure 7E:
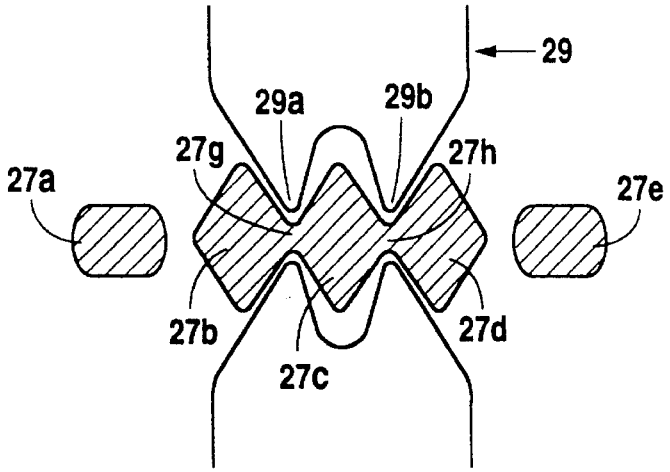

FIG. 7(E) shows a process in which connected three strands 27*b*, 27*c* and 27*d* are cut off by means of the second pair of slitter rollers 29 having two edges 29*a* and 29*b* along the connection portions 27*g* and 27*h*.

Figure 7F:
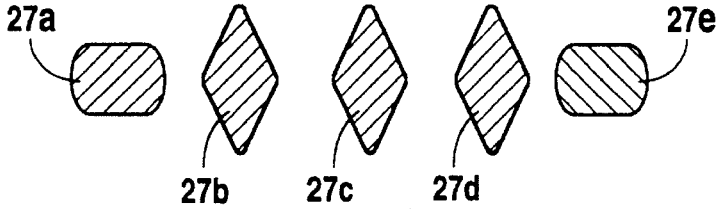
Figure 7G:
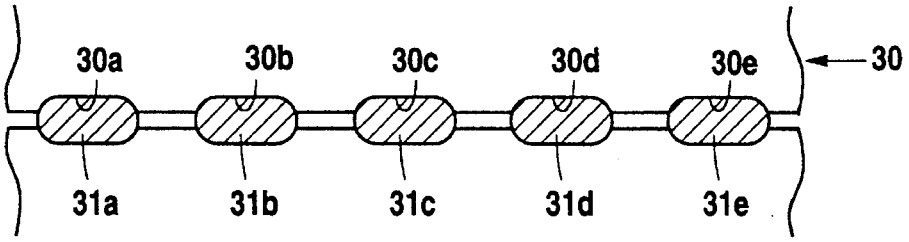
Figure 7H:
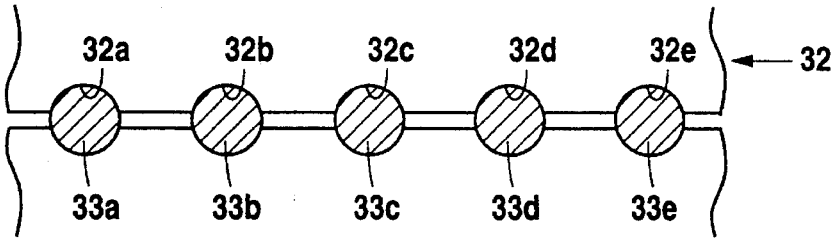

FIGS. 7(F) to 7(H) show a process in which the cut strands 27*a* through 27*e* are rolled on the subsequent respective roller stands (not shown).

FIGS. 8(A) to 8(I) show roll calibers and deformation of the strands when six bars are simultaneously produced.

Figure 8A:
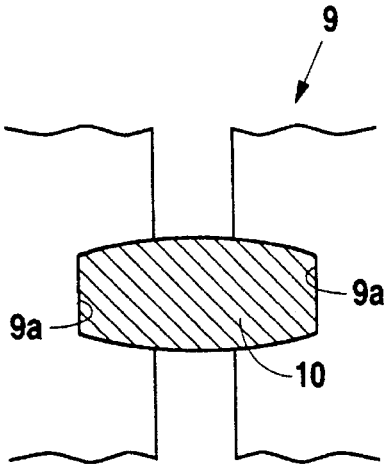
FIGS. 8(A) to 8(I) are explanatory views showing the processes of deformation of the strands by roll calibers from the roll strands in the case of simultaneously rolling six strands of bars.
Figure 8B:
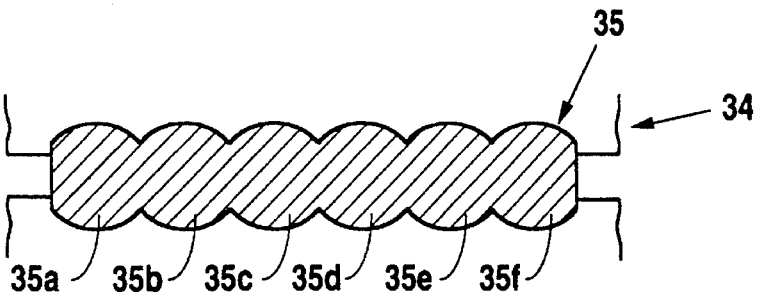
Figure 8C:
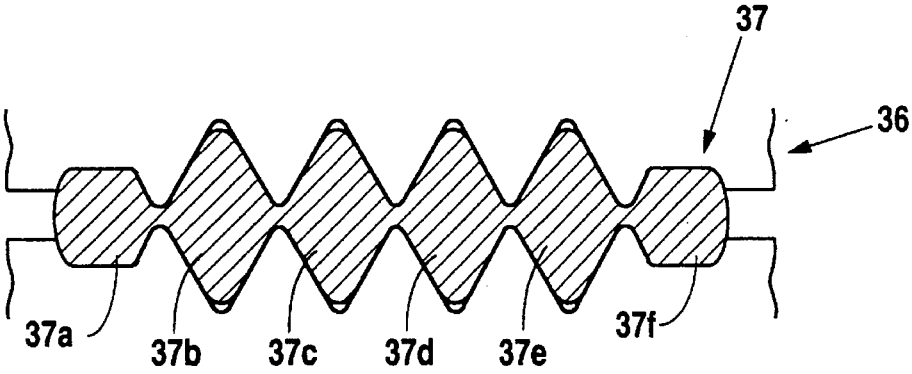

FIG. 8(A) shows the deformation of the billet 10 in a pair of rolls 9. FIG. 8(B) shows the deformation of the strands in the pair of rolls 34. FIG. 8(C) shows the deformation of the strands in the pair of rolls 36.

Figure 8D:
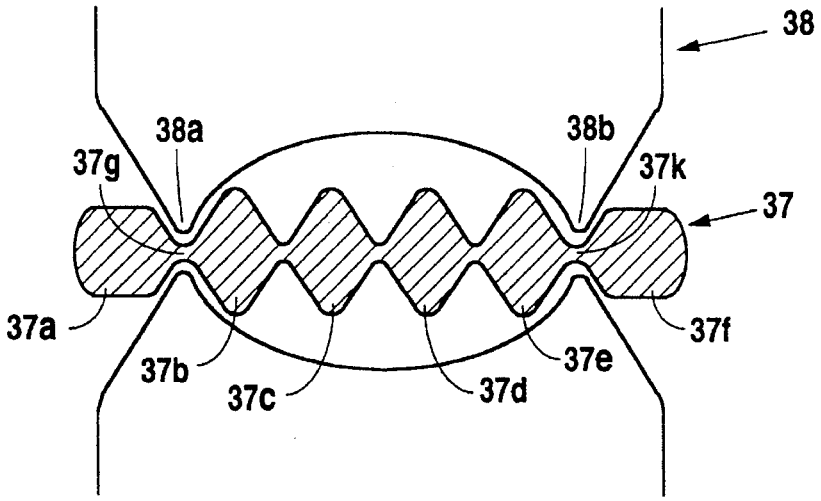
Figure 8E:
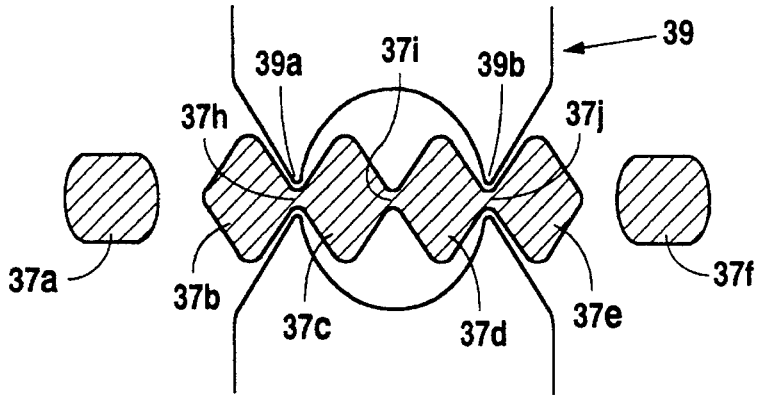

FIG. 8(D) shows a cutting procedure of the strands by means of the first pair of slitter rollers 38. FIG. 8(E) shows a cutting procedure of the strands by means of the second pair of slitter rollers 39.

Figure 8F:
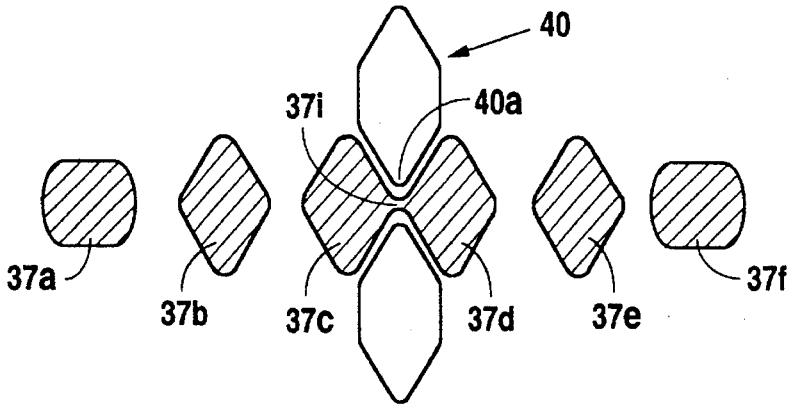

FIG. 8(F) shows a cutting procedure of the strands by means of the third pair of slitter rollers 40.

Figure 8G:
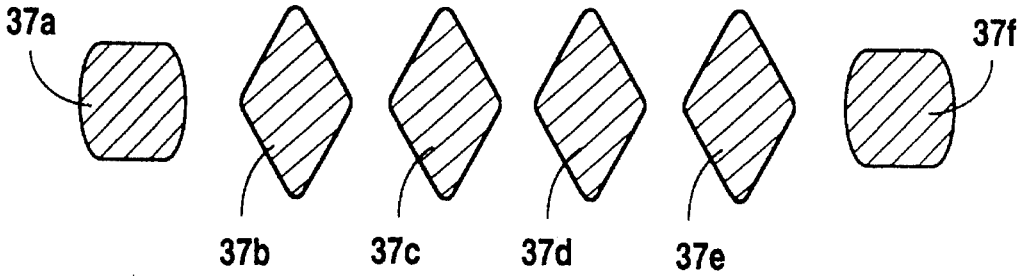
Figure 8H:
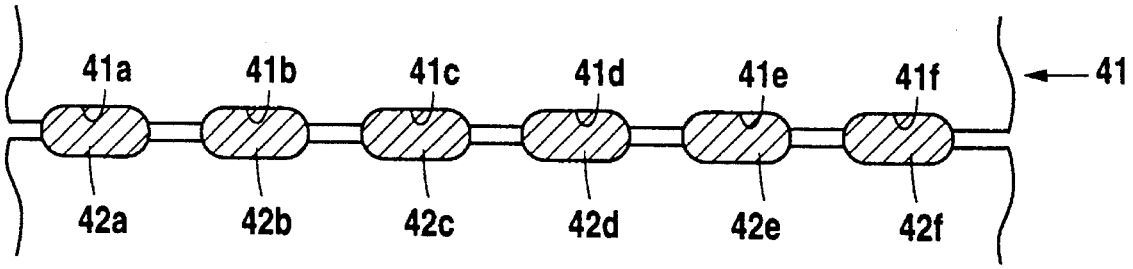
Figure 8I:
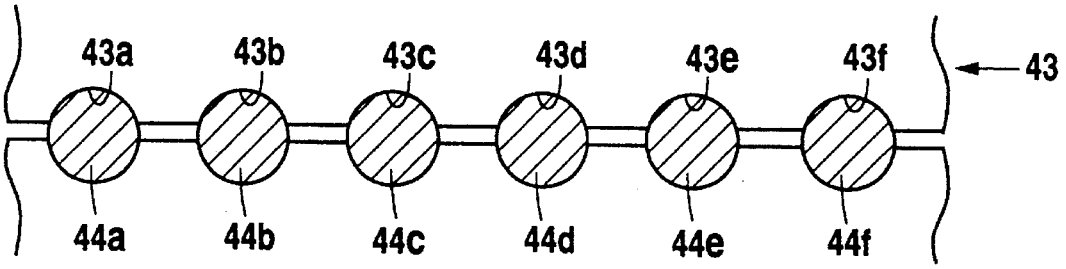
Figure 9A:
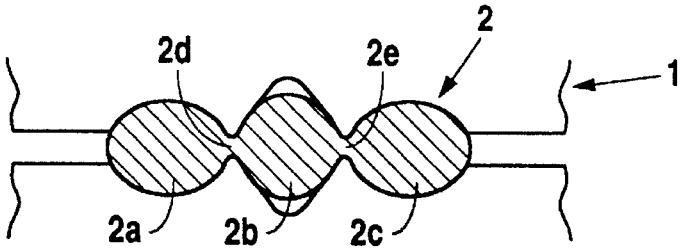
Fig. 9A (PRIOR ART)
FIGS. 9(A) to 9(C) are explanatory views showing the processes of rolling in the "Prior Art 1."
Figure 9B:
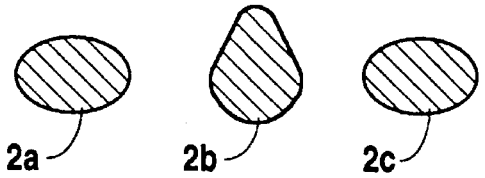
Fig. 9B (PRIOR ART)
Figure 9C:
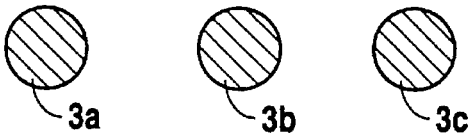
Fig. 9C (PRIOR ART)
Figure 10A:
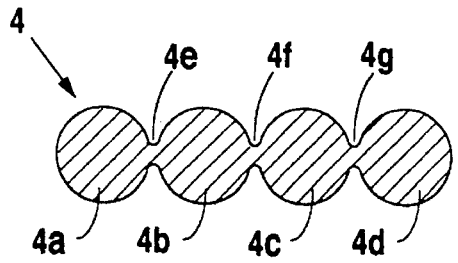
Fig. 10A (PRIOR ART)
FIGS. 10(A) to 10(D) are explanatory views showing the processes of rolling in the "Prior Art 2."
Figure 10B:
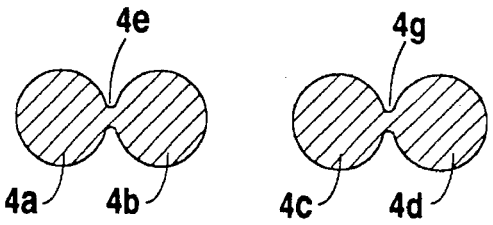
Fig. 10B (PRIOR ART)
Figure 10C:
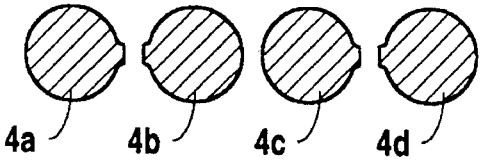
Fig. 10C (PRIOR ART)
Figure 10D:
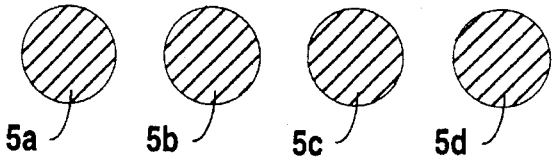
Fig. 10D (PRIOR ART)
Figure 11:
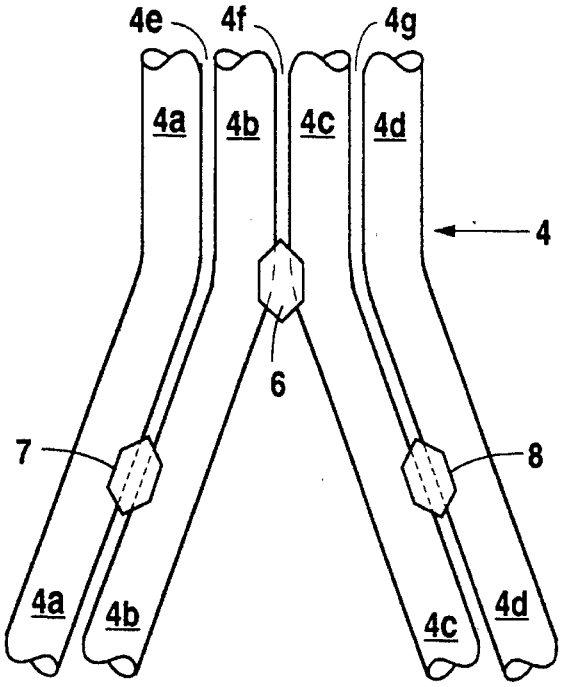
Fig. 11 (PRIOR ART)
FIG. 11 is an explanatory view showing an arrangement of pairs of slit rolls in the "Prior Art 2."

FIGS. 8(G) to 8(I) show a process in which cut strands 37*a* through 37*f* are rolled on the subsequent respective roller stands (not shown).

If the number of bars to be simultaneously produced is N ($N \geqq 4$), $\frac{1}{2} \times N$ pairs of slitter rollers are provided in the slitter rollers guide when N is an even number. When N is an odd number, $\frac{1}{2} \times (N-1)$ pairs of slitter rollers are provided in the slitter rollers guide.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims. The foregoing disclosure and description of the invention are illustrative and explanatory thereof. Various changes in the size, shape and materials as well as the details of the illustrated construction may be made without departing from the spirit of the invention.

We claim:

1. Apparatus for use in simultaneously forming four metal rounds comprising:

a first pair and a second pair of forming rollers each roller having a forming surface, the first pair and second pair being connected in series to sequentially pass a bar in a first pass and a second pass through the roller forming surfaces, each pair having an adjustable separation distance with the directions of adjustment being substantially non-parallel;

grooves in the forming surface of at least one roller of each of the first pair and the second pair, dimensioned in combination to form the bar at the completion of the second pass into four connected strands of substantially equal cross sectional area; and a pair of pre-slitter forming rollers connected downstream of the first and second roller pairs having an adjustable separation distance, the pre-slitter rollers having forming surfaces defining two central grooves and two outside grooves, the four grooves being separated by three serial ridges with each central groove defining a central groove cross sectional area and each outside groove defining a strand cross sectional area, the central groove cross sectional area exceeding the strand cross sectional area by a free space area, the free space area being sufficient to accommodate a variance in strand cross sectional area without requiring redistribution of metal from strands within central grooves to strands within outside grooves;

the pre-slitter grooves and pre-slitter ridges dimensioned in combination with the grooves of the first and second forming roller pairs to form a bar comprised of four serial strands of substantially equal cross sectional area separated by thin connecting portions.

2. The apparatus of claim 1 wherein each roller of the first roller pair has a groove oriented with respect to the entering bar such that each groove forms an end portion of the bar, the separation distance between the surfaces of the first roller pair determining the width of the bar and the width of the groove in each roller of the first pair determining the cross sectional height of an end portion of the bar.

3. The apparatus of claim 1 wherein the rollers of the second pair are oriented with respect to the entering bar such that the separation distance between the roller surfaces determine the height of the central portion of the bar.

4. The apparatus of claim 3 wherein the rollers of the second pair have ridges for forming the bar into four portions separated by thick connecting portions.

5. The apparatus of claim 1 wherein the two outside ridges of the pre-slitter roller have outside and inside slope angles of approximately 30°.

6. The apparatus of claim 1 wherein the inside ridge of the pre-slitter roller has slope angles of approximately 30°.

7. Apparatus for use in simultaneously forming metal rounds from a bar guided to the apparatus, the bar being comprised of four serial strands, two outside and two middle, separated by thin connecting portions, the apparatus comprising:

a first pair of slit rolls, a first ridge and a second ridge on each roller of the first pair, the first ridges being located to correspond with a thin portion connecting a first outside strand to a first middle strand, the second ridges being located to correspond with a thin portion connecting a second outside strand to a second middle strand, each ridge having an outside ridge slope angle greater than an inside strand slope angle of a corresponding portion of the outside strand; and means serially connected downstream of the first pair of slit rolls, for separating the two middle strands.

8. The apparatus of claim 7 wherein outside slope angles of the ridges of the first slitter rollers exceed inside slope angles of the corresponding portions of the outside strands by approximately 22°.

9. The apparatus of claim 7 wherein the outside slope angles of the ridges of the first slitter rollers are approximately 52°.

10. The apparatus of claim 7 wherein an inside slope angle of each ridge of the first slitter rollers is less than an outside slope angle of corresponding portions of the middle strand.

11. The apparatus of claim 10 wherein inside slope angles of the ridges of the first slitter rollers are approximately 25°.

12. The apparatus of claim 7 wherein the means for separating the two middle strands is comprised of a second slitter roller pair having at least one roller with a ridge located to correspond to the thin connecting portion between the two middle strands, the second slitter roller ridge having a ridge slope angle greater than a corresponding inside strand slope angle of the middle strand.

13. The apparatus of claim 12 wherein the slope angle of the second slitter roller ridge exceeds the inside slope angle of a middle strand by approximately 5°.

14. The apparatus of claim 13 wherein the slope angle of the second slitter roller ridge is approximately 35°.

15. A method for slitting a bar comprised of four serial strands, two outside and two middle, of approximately equal cross sectional area separated by thin connecting portions, comprising:

passing the bar by a first pair of slitter rollers, each having two ridges with interfering outside ridge slope angles and noninterfering inside ridge slope angles, thereby separating a first outside strand from a first middle strand and a second outside strand from a second middle strand by applying a lateral force with portions of an outside surface of a ridge to portions of an inside surface of an outside strand without applying significant lateral force with an inside surface of a ridge to an outside surface of a middle strand; and subsequently separating the two middle strands.

16. A method for simultaneously producing N (N is at least four) strands of metal bars from a single preformed billet, comprising the steps of:

(1) forming a single preformed billet;

(2) then, rolling said preformed billet into N strands having substantially the same cross sectional area and connected to each other by means of thick connecting portions;

(3) then, rolling said N strands into N strands having substantially the same cross sectional area and connected to each other by means of thin connecting portions;

(4) then, cutting off each of strands positioned on both outermost sides from said N strands along the respective connecting portions;

(5) subsequently cutting off each of strands positioned on both outermost sides from remaining strands not yet cut off along the respective connecting portions;

(6) repeating said cutting as defined in step (5) until all the remaining strands of said N strands are cut off along the respective thin connecting portions, when N is odd;

(7) cutting off the last two strands of said remaining strands not yet cut off along the thin connecting portion, when N is even; and (8) then, simultaneously rolling said cut-off N strands into N strands of metal bars.

17. A method for simultaneously producing N (N is at least four) strands of metal bars from a single preformed billet, comprising the steps of:

(1) forming a single preformed billet;

(2) then, rolling said preformed billet into N strands having substantially the same cross sectional area and connected to each other by means of thick connecting portions;

(3) then, rolling each of strands posited on both outermost sides of said N strands into an oval or box cross section, and rolling each of remaining strands into a diamond cross section, all of said strands being connected to each other by means of thin connecting portions;

(4) then, cutting off each of strands positioned on both outermost sides from said N strands along the respective connecting portions;

(5) subsequently cutting off each of strands positioned on both outermost sides from remaining strands not yet cut off along the respective connecting portions;

(6) repeating said cutting as defined in the step (5) until all the remaining strands of said N strands are cut off along the respective thin connecting portions, when N is odd;

(7) cutting off the last two strands of said remaining strands not yet cut off along the thin connecting portion, when N is even; and (8) then, simultaneously rolling said cut-off N strands into N strands of metal bars.

18. A method for simultaneously producing N (N is at least four) strands of metal bars from a single preformed billet, comprising the steps of:

(1) forming a billet into a single preformed billet by means of a roughing rolling train of a bar rolling mill; and (2) subsequently rolling said preformed billet into N strands of metal bars by means of a finishing rolling train of said bar rolling mill in accordance with the steps as defined in claim 17.

19. The method of any one of claims 16 to 18 wherein N strands comprises four strands.

20. The method of any one of claims 16 to 18 wherein N strands comprises five strands.

21. The method of any one of claims 16 to 18 wherein N strands comprises six strands.

22. A slit roll guide for simultaneously producing N (N is at least four) strands of metal bars, comprising:

(1) ½×(N−1) pairs of slit rolls arranged in series in a rolling direction when N is odd, each pair of said ½×(N−1) pairs of slit rolls having two pairs of edges;

(2) ½×(N pairs of slit rolls arranged in series in a rolling direction when N is even, each pair of ½N−1 pairs of slit rolls out of said ½×N pairs of slit rolls having two pairs of edges, and a last pair of slit rolls out of said ½×N pairs of slit rolls having a single pair of edges;

(3) said pairs of slit rolls, each pair of which has said two pairs of edges, being arranged in series in a rolling direction so that a distance between said two pairs of edges of each pair of slit rolls sequentially becomes smaller in the rolling direction;

(4) said last pair of slit rolls, which has said single pair of edges, being arranged at a last position in a rolling direction when N is even; and (5) said edges of said pairs of slit rolls being parallel to the rolling direction, and edges of each pair of edges of said pairs of slit rolls symmetrically facing each other.

23. A finishing rolling train equipment for simultaneously producing N (N is at least four) strands of metal bars, comprising:

(1) first to fourth roll stands ($K_4$, $K_3$, $K_2$, and $K_1$) arranged in series in a rolling direction, each of said first to fourth roll stands having a pair of calibered rolls for rolling strands of metal bars; and (2) a slit roll guide as defined in claim 22 arranged between said second roll stand ($K_3$) and said third roll stand ($K_2$).

24. A bar rolling mill equipment for simultaneously producing N (N is at least four) strands of metal bars, comprising:

(1) a roughing rolling train; and (2) a finishing rolling train as defined in claim 23 installed directly following said roughing rolling train.

* * * * *